United States Patent [19]

Wood

[11] 4,084,309

[45] Apr. 18, 1978

[54] APPARATUS AND METHOD OF MANUFACTURING FLEXIBLE DUCTING

[76] Inventor: Cecil Howard Wood, 129 Arnold Ave., Thornhill, Canada

[21] Appl. No.: 712,483

[22] Filed: Aug. 9, 1976

[51] Int. Cl.[2] ..... B23Q 5/00

[52] U.S. Cl. ..... 29/561; 29/819; 29/243.58; 29/509; 72/142

[58] Field of Search ..... 29/505, 509, 819, 243.58, 29/561; 72/49, 142

[56] References Cited

U.S. PATENT DOCUMENTS

| | | | |
|---|---|---|---|
| 2,506,232 | 5/1950 | Murphy | 29/819 X |
| 2,539,814 | 1/1951 | Chernack | 29/561 |
| 2,592,336 | 4/1952 | Rejeski | 29/561 |
| 2,636,541 | 4/1953 | Rutherford | 29/819 X |

FOREIGN PATENT DOCUMENTS

| | | | |
|---|---|---|---|
| 112,330 | 1/1941 | Australia | 29/243.58 |

*Primary Examiner*—Charlie T. Moon
*Attorney, Agent, or Firm*—Kerry Maxwell Hill

[57] ABSTRACT

An apparatus and method for manufacturing flexible duct comprising feeding a strip of cloth and a channel formed strip of metal in parallel through a work station having a pair of crimping rollers which fasten an edge of the fabric into the channel. A forming ring is provided at the work station to guide a first coil of fabric attached to channel strip around to meet and overlap a second coil of fabric being fed into the work station. A roller member is rotatably fixed above the work station to force the overlapping edges of adjacent coils of fabric down into the channel of the metal strip being simultaneously fed in parallel with the fabric toward the crimping rolls. The roller member carries with it a string which it inserts into the channel over the overlapping edges of the fabric prior to the combined materials being fed into crimping rollers where they are forced into a retained and fixed position within the enfolded arms of the crimped channel of metal. The string provides a filler to bulk up the interior of the channel cavity to prevent the overlapping edges being pulled out of the seam provided by the closed channel of metal strip.

2 Claims, 9 Drawing Figures

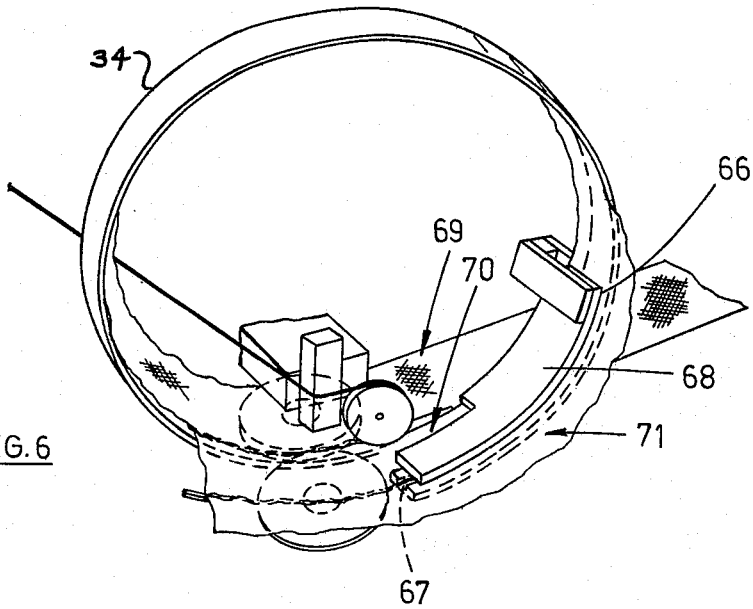
FIG. 6
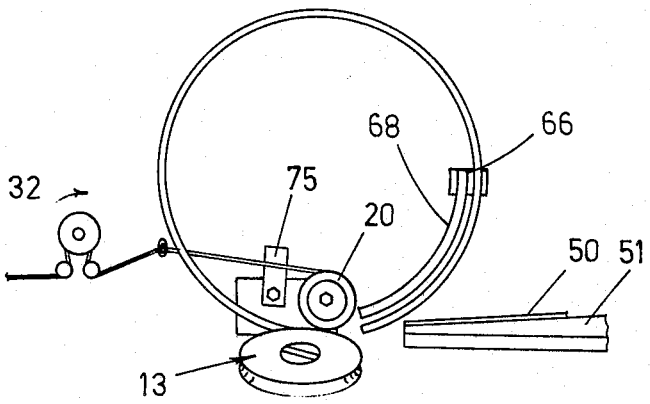
FIG. 7
FIG. 8
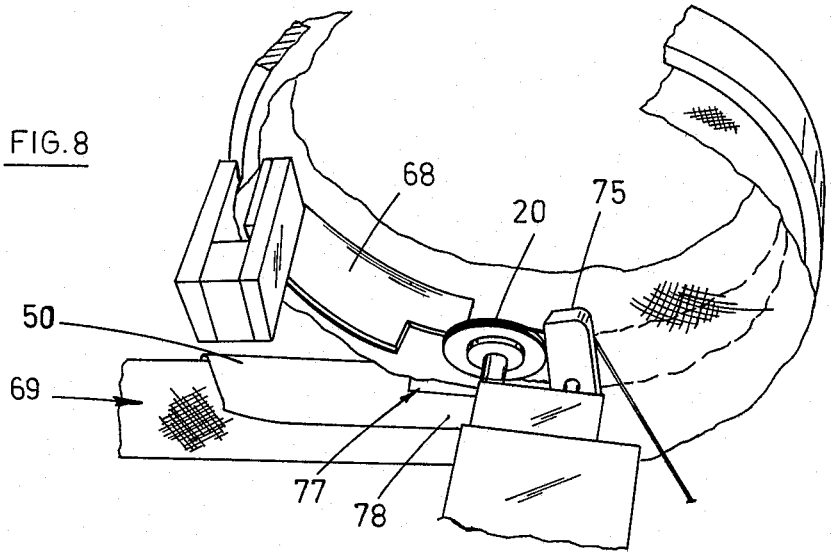

APPARATUS AND METHOD OF MANUFACTURING FLEXIBLE DUCTING

The present invention relates to an apparatus for forming flexible duct and in particular relates to apparatus and means for forming a strip of fabric into a helical coil of ducting with a metallic seam or joint maintaining the edges of adjacent coils of fabric together. The seam or joint appears as a spiral of coils with the fabric appearing as a web between adjacent coils. The ductery can be flexed the width of the free strip of fabric between the coils.

PRIOR ART

There are known devices for joining adjacent edges of strip material together to form a helical coil or spiral of wire with fabric between the adjacent coils to form a flexible duct. There is not known of a method of forming a duct with the seam or joint facing outwardly and joining the edges of the fabric inwardly of the coil to allow the metallic seam to be a protective covering for the coiled duct. The known flexible ducts have the coil seam inside with the fabric entirely covering the finished product outwardly which product has the disadvantage of being easily damaged or punctured during installation and usage. The duct manufactured with the herein disclosed apparatus has the wire coils facing outwardly thereby providing a protective covering for the fabric web.

The object of the invention is to provide an apparatus to form a fabric strip into a coil or spiral with adjacent edges of the coiled fabric overlapping and to hold the overlapping edges of the fabric in permanent attachment by means of a metal seam or joint which also provides a spiral covering for the fabric when in coiled position.

SUMMARY OF THE INVENTION

The invention herein comprises feeding a strip of cloth and a channel formed strip of metal in parallel through a work station having a pair of crimping rollers which fasten an edge of the fabric into the channel. A forming ring is provided at the work station to guide the first coil of fabric around to meet and overlap a second coil of fabric being fed into the work station. A roller member is rotatably fixed above the work station to force the overlapping edges of adjacent coils of fabric down into the channel of the metal strip being simultaneously fed in parallel with the fabric toward the crimping rolls. The roller member carries with it a string which it inserts into the channel over the overlapping edges of the fabric prior to the combined materials being fed into the crimping rollers where they are forced into a retained and fixed position within the enfolded arms of the crimped channel of metal. The string provides a filler to bulk up the interior of the channel cavity to prevent the overlapping edges being pulled out of the seam provided by the Closed Channel of metal strip. With the considerations and inventive objects herein set forth in view, and such others as may become apparent from consideration of this disclosure and specification, the present invention consists of and is hereby claimed to reside in the inventive concept which is comprised, embodied, embraced or included in any method, process, construction, composition, arrangement or combination or parts, or new use of any of the foregoing which may herein be exemplified in one or more specific embodiments of such concept, reference being had to the accompanying drawings in which:

FIG. 6 shows the guide ring in place on the apparatus with a duct in the process of being formed, and with the string roll pressing the string and overlapping strips into the Channel.

FIG. 7 is an end view of the guide ring and press roller operatively positioned at the work station, and showing how one crimp roller is angled downwardly to allow a formed duct to clear the work station.

FIG. 8 is a view from within the work station showing the press roller operating and showing the sleeve chute guiding the cloth strip into correct overlapping position with the strip pulled down from the forming ring.

In the drawings like reference numerals designate similar parts in the several figures.

THE EMBODIMENT OF THE INVENTION AS DEPICTED IN THE DRAWINGS

Figure 1:
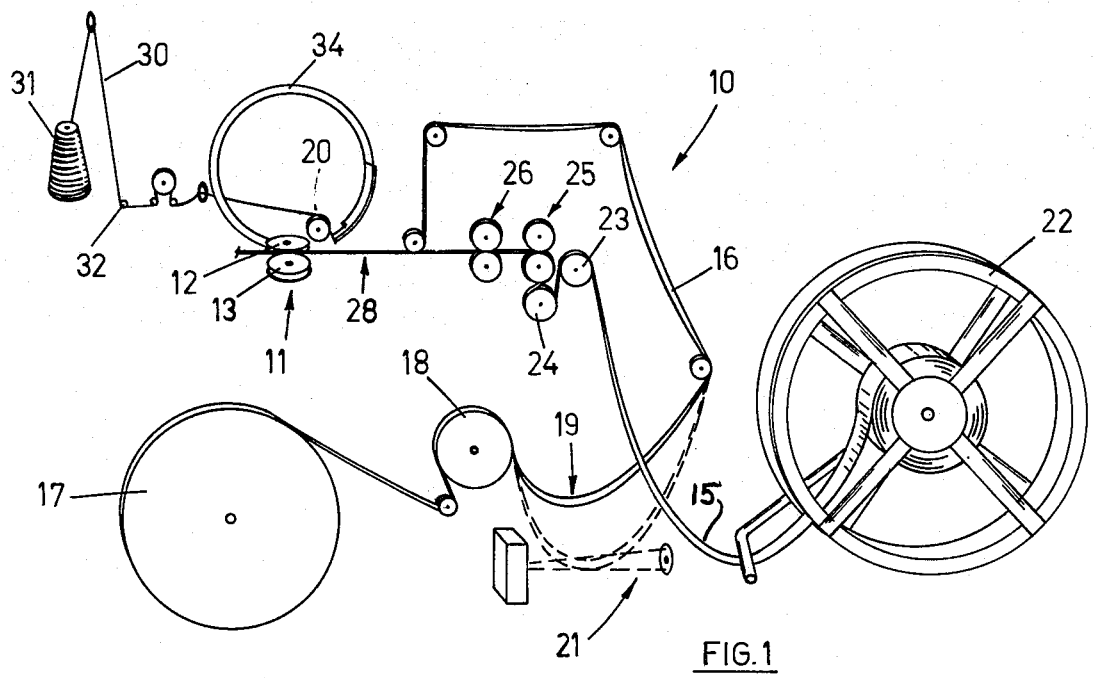
FIG. 1 is a partially perspective and partially schematic view of the apparatus herein, showing the metal strip, fabric, and string each being fed to the work station where the guide roll encloses the emerging duct being formed thereat.

In FIG. 1 the apparatus for producing a length of flexible, spiral duct having a metalic seam joining the edges of adjacent strips of flexible material is designated numeral 10, and comprises a fixed work station 11, having a pair of crimping rollers 12, 13, rotating in opposite direction to one another against the legs of a channel 28 strip of metal to close the channel about the adjacent edges of cloth strip material 16, as shown hereafter.

A guide ring 14 is removeably mounted on the work station 11 to guide an incoming channel 28 into a spiral coil. The ring 34 determines the size of the coil and therefore various sizes of guide ring will be available to produce various diameters of duct. A coil of cloth webbing 17 is freely mounted to allow the power decoiler 18 to pull the webbing freely from the roll. The power decoiler operates to create a loop in the webbing or cloth strip 16 so that there is negative tension on the cloth as it is drawn into the work station by the action of the wheel 20 pressing the cloth into the channel of the seam strip 28. An electric beam means 21 ensures that loop 19 does not exceed a desired amount as shown in FIG. 1 thereby keeping the cloth webbing fed at near constant zero tension.

Figure 5A:
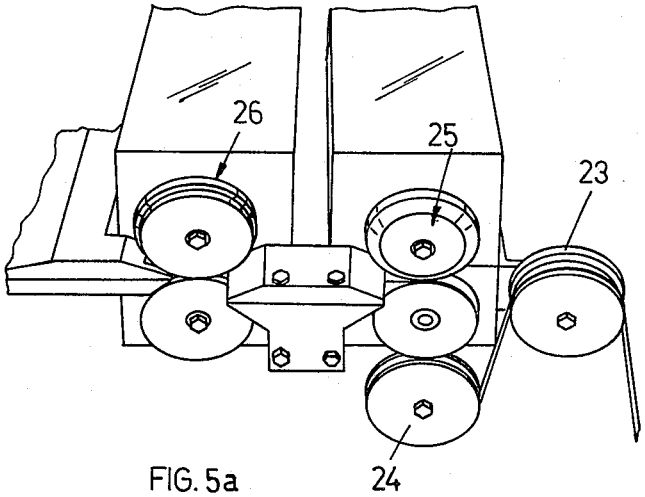
FIG. 5(a) is a perspective view of the rotating roller means for converting the strip of sheet metal into a Channel shape prior to feeding it to the duct machine.
Figure 5B:
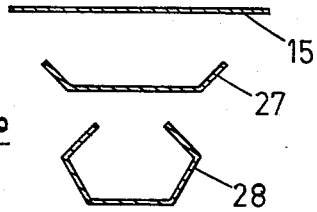
FIG. 5(b) shows the 3 stages of forming the Channel from flat stock strip to Channel.

22 is a roll of stock steel strip metal to be used as the seams or joint between laps or coils of webbing on the duct. Rolls 23 and 24 pull the strip 15 into two pairs of form rollers, 25 and 26. The first set of rolls 25 form the strip into channel shape 27 as shown in FIG. 5(*b*) and the second set of rollers 26 form the channel 27 into shape 28 as in FIG. 5(*b*).

A continuous length of string 30, is drawn from a bobbin 31 by the wheel 20. The string is kept in tension by tensioner means 32. The metal strip channel 28 is fed into the work station 11 and is there guided into a suitable diameter coil by the guide roll 34.

Figure 2:
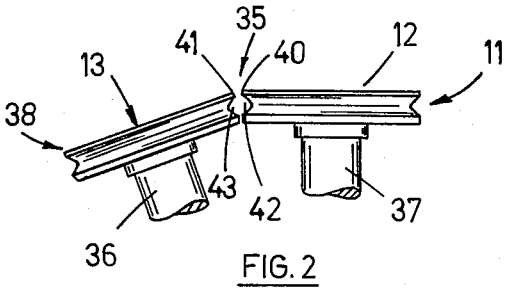
FIG. 2 is a sectional view through the crimping rolls to show how the rolls meet to close the channel strip to form the seam.

The crimping rollers 12, 13, are rotatably mounted at the work station 11 by suitable shafts 36, 37. Roller 13 is angled downward from the horizontal plane of the work station to allow the workpiece, (the coil being produced) to clear the roll surface. The edges 40, 41, of the rolls are formed with cavities 42, 43, into which the channel 28 is drawn the upper edges of the rolls 41, 40 crimp the channel seam shut by their rolling action at 35. (FIG. 2)

Figure 3:
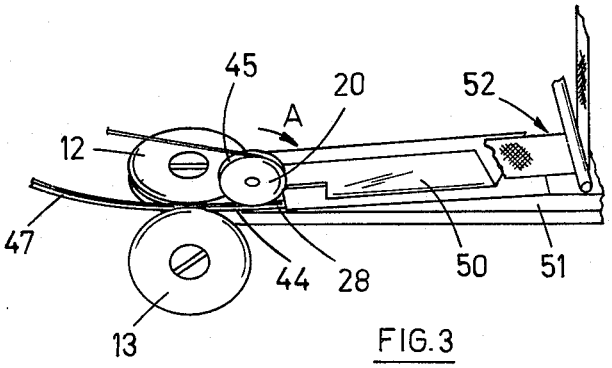
FIG. 3 is a view of the work station without the guide ring in place but showing the string roll pressing the string into the Channel opening prior to crimping of the Channel arms. A fabric strip is shown being fed into the guide sheath or chute.

In FIG. 3, the press roller 20 is rotatable in direction of arrow A into the cavity 44 formed in the channel 28 of the metal strip from the roll 22 of FIG. 1.

The press roll 20 carries string 30 under tension in a groove 45 formed around its circumference and pushes the string 30 into the cavity 44 of channel 28. The channel is pinched closed at 35 by the crimp rollers 12 & 13 and emerges as a closed joint or seam 47. The web of flexible material 16 (ductile metal, fabric or plastic) is drawn into engagement with the channel 28 by the pull of the rotating Press roll 20, a guide chute or sleeve 50 rests on the bed 51 of the work station 11, to ensure that an edge 52 of the web is properly directed, in parallel relation to the metal seam, to the work station. The web 16 is fed or pulled between the string 30 and the channel by the press roll 20 and thereby forced into the cavity 44 of channel 28 before and with the string.

Figure 4:
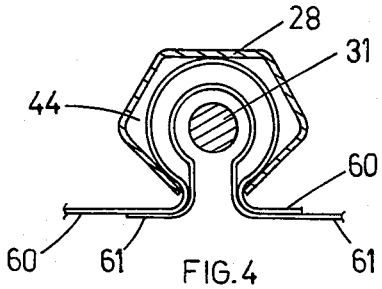
FIG. 4 is a sectional view of a closed Channel seam with the overlapping edges of adjacent strips of cloth, and the string enclosed therein.

In FIG. 4, the string 31 is shown between two overlapping edges of fabric 60, 61, to fill the cavity 44 of the channel 28 prior to pinching closed by rolls 12, 13.

As the channel emerges from the crimp rolls with a pair of adjacent edges of fabric and a length of string held fast within its cavity, it encircles the inner side 66, of guide ring 34 drawing the fabric with it. The guide ring 34 directs the channel outward from the work station 11 in spiral form, by means of a track 67 spiralling around the inner side of the guide ring 66. A guide 68 is attached to the inner side the ring 34 to hold the fabric attached to the channel in the correct position for parallel overlap of the strip of fabric being drawn into the chute or sleeve 50. As the press roll 20 pulls the strip 69 (FIG. 6) into engagement with the channel cavity of the spiral of the channel being fed from the forming rolls and drawn by the crimp rolls, the adjacent strip of fabric is spaced apart from the press roll 20 the exact correct distance to allow the proper overlap by the guiding of the channel holding web 70 and 71, in the track 67 and held there by guide clamp 68. The guide ring 34 therefore governs both the diameter of duct and the width of the web between coils or seams. Changing ring sizes and structures will vary the diameter and the overlap.

The cord or string 32 must be under a constant tension to provide the uniform quality of friction filling characteristics when it is pressed into the cavity against the overlapping fabric edges. A Tensioner 32 is provided at the work station and guide means 75 ensures that the string runs onto the press roll 20 uniformly and in line with the plane of rotation of the roll 20.

A segment 77 is cut from the sleeve 50 to allow the adjacent strips of cloth to overlap prior to pressing by roll 20 but an extension 78 protrudes toward the press roll to overlie the outer side of the new coil of fabric to prevent the fabric from pulling from the cavity prior to the crimping and pinching closed of the channel by the crimp rolls.

It will be understood that the primary motive force is provided by the form rollers which convert the flat strip of metal into the channel seam for the duct. The rollers draw the strip through them to the work station. The force of the moving channel seam or strip in turn causes the string roll to rotate and draw string from the bobbin. The channel seam also draws the fabric into itself and to the work station. The forward force on the channel strip can also cause the crimp rolls to operate. In practice, however, auxilliary motive power is provided to the crimp rollers to operate but they do not draw the channel into themselves.

What I claim is:

1. An apparatus for forming flexible ducting from a channel-shaped strip of metal and a strip of flexible material wherein said metal strip is formed into a spiral with said material forming a web between adjacent coils of the spiral and wherein said metal is exposed outwardly of the ducting formed thereby to protect the flexible material forming the webbing of the ducting, comprising in combination;

a work station having a bed thereon;

a means for feeding said strip of metal to said work station to underlie said strip of flexible material disposed parallel to said metal strip, said flexible material being drawn onto said bed of said work station by movement of said metal strip underlying said material;

a roll member rotatably mounted above said bed to urge an edge of said material downwardly between the arms of said channel-shaped strip of metal when said strip of metal is fed thereunder;

a crimping means to close the channel arms of said metal strip over overlapping edges of flexible material caught therebetween;

a ring-shaped guide means fastened to said work station adapted to upwardly direct the channel-shaped metal strip with the flexible material held therein, into a spiral shape and to guide them around to lie adjacent and parallel to the incoming strip of flexible material with an edge of said material held by said metal channel strip in overlapping relationship with an edge of said incoming strip of flexible material.

2. The apparatus of claim 1 wherein said material is a fabric and wherein said roll member carries and inserts a continuous length of string into said channel of said metal strip above said flexible material prior to the combination of string and material is enclosed together by said crimping means.

* * * * *